US007227130B2

(12) United States Patent
Hager et al.

(10) Patent No.: US 7,227,130 B2
(45) Date of Patent: Jun. 5, 2007

(54) METHOD FOR PROVIDING BARRIER FIELDS AT THE ENTRANCE AND EXIT END OF A MASS SPECTROMETER

(75) Inventors: James W. Hager, Mississauga (CA); Frank A. Londry, Peterborough (CA)

(73) Assignees: MDS Inc., Concord, Ontario (CA); Applera Corporation, Framingham, MA (US)

( * ) Notice: Subject to any disclaimer, the term of this patent is extended or adjusted under 35 U.S.C. 154(b) by 0 days.

(21) Appl. No.: 11/133,325

(22) Filed: May 20, 2005

(65) Prior Publication Data

US 2005/0263697 A1 Dec. 1, 2005

Related U.S. Application Data

(60) Provisional application No. 60/572,489, filed on May 20, 2004.

(51) Int. Cl.
*H01J 41/42* (2006.01)

(52) U.S. Cl. ..... 250/282; 250/282; 250/288; 250/290

(58) Field of Classification Search ..... 250/282, 250/290, 292
See application file for complete search history.

(56) References Cited

U.S. PATENT DOCUMENTS 5,576,540 A 11/1996 Jolleffe
6,093,929 A 7/2000 Javahery et al.
6,177,668 B1 * 1/2001 Hager ..... 250/282
6,504,148 B1 1/2003 Hager
6,703,607 B2 3/2004 Stott et al.
7,049,580 B2 * 5/2006 Londry et al. ..... 250/282
2004/0238734 A1 12/2004 Hager et al.
2005/0263695 A1 12/2005 Syka

OTHER PUBLICATIONS

Dawson, P.H., "Quadrupole Mass Spectrometry and its Applications" AIP Press, Woodbury, New York, 1995 (210-216).

B.A. Collings, M. Sudakov and F.A. Londry, "Resonance Shifts in the Excitation of the n=0, K=1 to 6 Quadropole resonances for Ions Confined in a Linear Ion Trap," J. Am Soc Mass Spectrom 2002, 13, 577-586).

F.A. Londry and James W. Hager, "Mass Selective Axial Ion Ejection from a Linear Quadrupole Ion Trap", 2003 American Society for Mass Spectrometry, Published by Elsevier Inc. 1044-0305/03.

Syka, J. E. P. et al., "Peptide and Protein Sequence Analysis by Electron Transfer Dissociation Mass Spectrometry", The National Academy of Sciences of the U.S.A., vol. 101, No. 28, pp. 9528 to 9533, 2004.

*Primary Examiner*—John R. Lee
*Assistant Examiner*—David A. Vanore
(74) *Attorney, Agent, or Firm*—Bereskin and Parr

(57) ABSTRACT

A mass spectrometer and a method of operating same is provided. The mass spectrometer has an elongated rod set. The rod set has an entrance end and an exit end. An RF drive voltage is applied to the rod set to radially confine a first group of ions and a second group of ions of opposite polarity in the rod set. An entrance auxiliary RF voltage is applied to the entrance end and an exit auxiliary RF voltage to the exit end relative to the RF drive voltage, to trap both the first group of ions and the second group of ions in the rod set.

2 Claims, 13 Drawing Sheets

METHOD FOR PROVIDING BARRIER FIELDS AT THE ENTRANCE AND EXIT END OF A MASS SPECTROMETER

CROSS-REFERENCE TO RELATED APPLICATION

This is a non-provisional application of U.S. application No. 60/572,489 filed May 20, 2004. The contents of U.S. application No. 60/572,489 are incorporated herein by reference.

FIELD OF THE INVENTION

The present invention relates generally to mass spectrometry, and more particularly relates to a method and system of providing a barrier field to the entrance and exit ends of a linear ion trap mass spectrometer.

BACKGROUND OF THE INVENTION

Typically, linear ion traps store ions using a combination of a radial RF field applied to the rods of an elongated rod set, and axial direct current (DC) fields applied to the entrance end and the exit end of the rod set. Linear ion traps enjoy a number of advantages over three-dimensional ion traps, such as providing very large trapping volumes, as well as the ability to easily transfer stored ion populations to other downstream ion processing units. However, there have been problems with the use of such linear ion traps.

One such problem is that it has not typically been possible to simultaneously store positive ions and negative ions in a linear ion trap. This problem is due to the fact that while a particular axial DC field may provide an effective barrier to an ion of one polarity, the same DC field will accelerate an ion of opposite polarity out of the linear ion trap. Thus, linear ion traps relying on DC barrier fields have not typically been used to simultaneously store ions of opposite polarities.

Accordingly, there remains a need for linear ion trap systems and methods of operating linear ion traps that allow ions of opposite polarity to be trapped simultaneously.

SUMMARY OF THE INVENTION

In accordance with a first aspect of the present invention, there is provided a method of operating a mass spectrometer having an elongated rod set, the rod set having an entrance end and an exit end. The method comprises (a) providing a first group of ions within the rod set; (b) providing a second group of ions within the rod set, the second group of ions being opposite in polarity to the first group of ions; (c) providing a RF drive voltage to the rod set to radially confine the first group of ions and the second group of ions in the rod set; and, (d) providing an entrance auxiliary RF voltage to the entrance end and an exit auxiliary RF voltage to the exit end relative to the RF drive voltage, to trap both the first group of ions and the second group of ions in the rod set.

In accordance with a second aspect of the present invention, there is provided a mass spectrometer system comprising: a multipole rod set having an entrance end and an exit end; an entrance member near the entrance end of the multipole rod set; an exit member near the exit end of the rod set; an RF voltage power supply connected to the entrance member and the exit member for providing an entrance RF voltage to the entrance member and an exit RF voltage to the exit member; and an RF drive voltage power supply connected to the multipole rod set for providing an RF drive voltage to the multipole rod set to radially confine ions within the multipole rod set; wherein the auxiliary RF power supply is operable to supply the entrance RF voltage to the entrance member and the exit RF voltage to the exit member such that an entrance pseudo potential barrier is provided at the entrance end and an exit pseudo potential barrier is provided at the exit end of the multipole rod set.

BRIEF DESCRIPTION OF THE DRAWINGS

These and other advantages of the instant invention will be more fully and completely understood in conjunction with the following detailed description of the preferred aspects of the present invention with reference to the following drawings in which.

DETAILED DESCRIPTION OF EMBODIMENTS OF THE INVENTION

Figure 1:
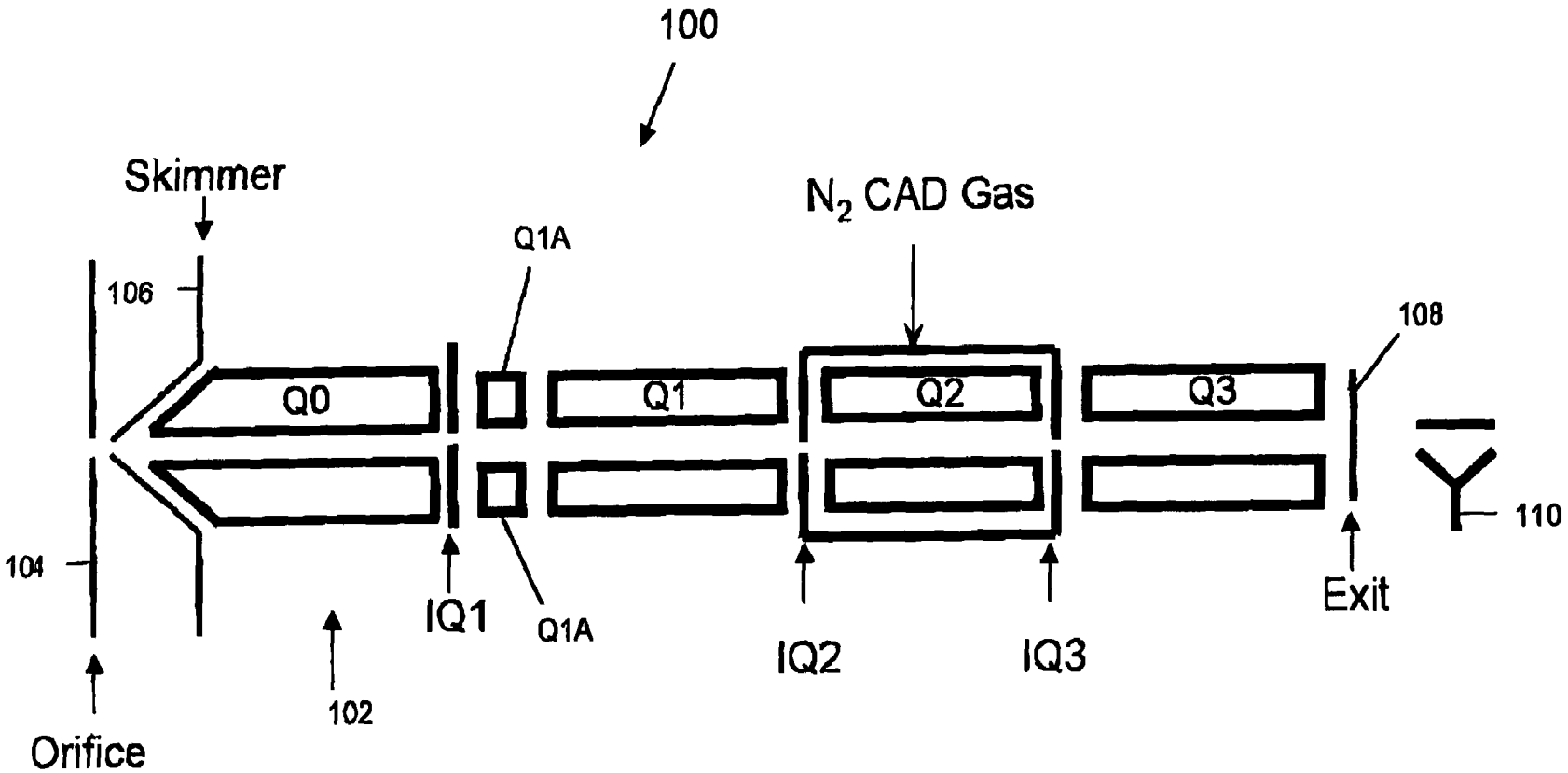
FIG. 1, in a schematic diagram, illustrates a Q-trap Q-q-Q linear ion trap mass spectrometer.

Referring to FIG. 1, there is illustrated in a schematic diagram a QTRAP Q-q-Q linear ion trap mass spectrometer 100, as described by Hager and LeBlanc in Rapid Communications of Mass Spectrometry 2003, 17, 1056–1064. During operation of the mass spectrometer, ions are admitted into a vacuum chamber 102 through an orifice plate 104 and a skimmer 106. The mass spectrometer 100 comprises four elongated sets of rods Q0, Q1, Q2 and 03, with orifice plates IQ1 after rod set Q0, IQ2 between Q1 and Q2, and IQ3 between Q2 and Q3. An additional set of stubby rods Q1A is provided between orifice plate 101 and elongated rod set Q1.

Ions are collisionally cooled in Q0, which may be maintained at a pressure of approximately $8\times10^{-3}$ torr. Both Q1 and Q3 are capable of operation as conventional transmission RF/DC quadrupole mass filters. Q2 is a collision cell in which ions collide with a collision gas to be fragmented into products of lesser mass. Ions may be trapped radially in any of Q0, Q1, Q2 and Q3 by RF voltages applied to the rods and axially by DC voltages applied to the end aperture lenses or orifice plates.

According to aspects of the present invention, an auxiliary RF voltage is provided to end rod segments, end lenses or orifice plates of one of the rod sets to provide a pseudo potential barrier. By this means, both positive and negative ions may be trapped within a single rod set or cell. Typically, positive and negative ions would be trapped within the high pressure Q2 cell. Once the positive and negative ions within Q2 have reacted, they can be axially ejected through IQ3 to 03, and from thence through an exit aperture lens 108 to a detector 110. Preferably, Q2 also includes a collar electrode, or other auxiliary electrodes, which, when a suitable potential is applied, can be used to confine thermal ions axially to a region close to the orifice plate IQ3. When ions are concentrated axially close to IQ3, the resulting mass spectra on ejection are better resolved.

As discussed by Dawson (Dawson, P. H., "Quadrupole Mass Spectrometry and its Applications" AIP Press, Woodbury, N.Y., 1995), the RF quadrupole electric field that contains ions radially in a linear ion trap can be characterized by a pseudo potential. Similarly, the height of the barrier, D, which is created when an RF potential is applied to a containment lens at an end of an ion trap will depend on the amplitude, V, the frequency, F, of the RF signal, as well as on the mass-to-charge ratio, m/z, of the ion, according to the equation:

$$D = C\frac{zV^2}{mF^2} \tag{1}$$

where C is a constant.

The auxiliary RF voltage provided to orifice plates IQ2 and IQ3 at either end of Q2 can be created in many different ways Three different approaches for providing an auxiliary RF voltage to an end lens of a rod set are described below. According to the first approach, an auxiliary RF voltage is applied directly to a containment lens. According to the second approach, the drive RF is applied with opposite polarity, but in unequal proportion, to the two poles of a linear quadrupole. According to the third approach, a capacitive divider is used to apply fixed fraction of the RF drive voltage to a containment lens.

Figure 2:
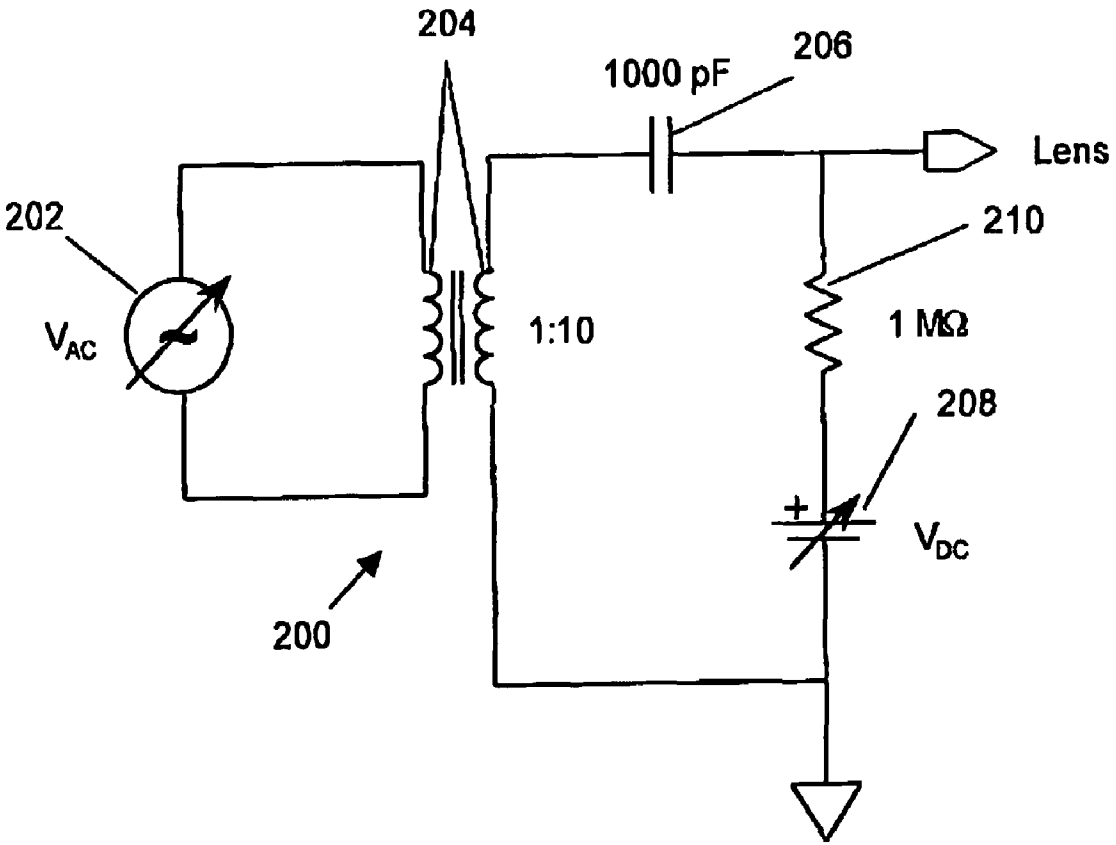
FIG. 2, in a schematic diagram, illustrates a circuit for providing an auxiliary RF signal to a containment lens of an ion guide in accordance with an aspect of the present invention.

Referring to FIG. 2, there is illustrated in a schematic diagram, a circuit 200 for providing an auxiliary RF signal to a containment lens directly. The circuit 200 of FIG. 2 has the advantage of allowing the frequency and amplitude of the auxiliary RF (AC) signal applied to the containment lens, or other ion-path component, to be controlled independently of other RF voltage supplies. The circuit 200 comprises an AC or RF voltage source 202, which may be a signal generator or an amplified signal generator. A transformer 204 is a 1:10 transformer that increases the amplitude of $V_{AC}$ by a factor of 10. A 1000 pF capacitor 206 isolates the transformer from a direct current voltage source 208, which provides a DC offset to the containment lenses or orifice plates. A 1 MΩ resistor 210 isolates the DC supply 208 from the auxiliary RF signal. The resistor 210 and the capacitor 206 create a high-pass filter; however, attenuation will typically be negligible, even, at 1 kHz. As the AC voltage resource 202 is separate from the drive voltage applied to the rods, the auxiliary RF signal can be controlled independently of the drive RF voltage in terms of both of its amplitude and its frequency.

Figure 3:
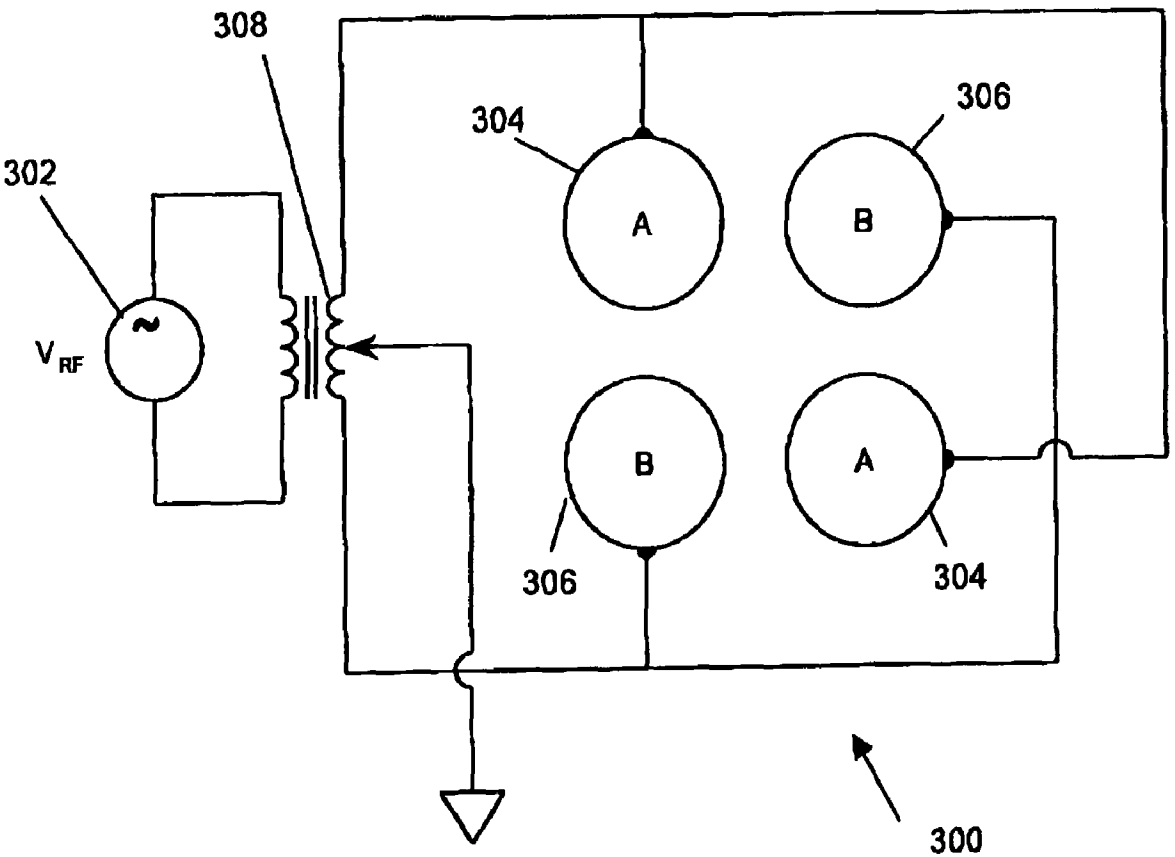
FIG. 3, in a schematic diagram, illustrates a circuit for providing, relative to a drive RF voltage applied to a rod set of an ion guide, an auxiliary RF voltage at the exit end and entrance end of the ion guide in accordance with the second aspect of the present invention.

Referring to FIG. 3, there is illustrated in a schematic diagram, a circuit 300 for providing, relative to the RF drive voltage, an auxiliary RF signal to the containment lenses of a multiple ion guide. Specifically, an RF drive voltage source 302 is connected to the A poles 304 and B poles 306 via a coil 308 having a variable-position center tap. By this means $V_{RF}$ is applied to the A poles 304 and B poles 306 in unequal proportion. A variable capacitor may also be used to balance the variable inductance of the circuit 300. It is noteworthy that in the axially central region of any linear multipole assembly, where end effects are negligible and there is no reference to ground, the relative magnitude of the RF signal applied to each pole has no impact on ion motion. In that so-called 2D region, ion trajectories are governed by the difference in potential between the two poles. However, near the axial ends of a multipole rod assembly, where some reference to ground exists, through a DC lens power supply for example, the consequence of a quadrupole RF potential, applied in unequal proportion between the two poles becomes significant.

Specifically, a configuration in which the RF amplitude is apportioned unequally between the poles of any multipole is equivalent to one in which the RF amplitude is balanced between poles and an auxiliary signal, at the RF frequency, is applied to an adjacent lens, with the same phase as the RF drive on one of the poles. That is, because the zero of potential is arbitrary, adding the same signal to all electrodes changes nothing.

For example, beginning with the RF amplitude balanced between poles, add to an adjacent lens 10% of the RF signal on A-pole. Now, using the principle of superposition, subtract the signal, which was applied to the lens, from all electrodes. This leaves no signal on the lens, while the RF signal on A-pole is reduced by 10% and the RF signal on B-pole is increased by 10%. (The amplitude of the signal on B-pole is increased because it is 180° out of phase with the A-pole signal.) Therefore, consider a configuration in which a nominally balanced RF drive is unbalanced by reducing the amplitude of the RF signal applied to A-pole by 10% and increasing the amplitude of the RF signal applied to B-pole by 10%. That configuration is equivalent to a configuration where the RF drive is balanced between poles and 10% of the RF signal, which appears on A-pole, is applied with the A-pole phase to the lens.

In the absence of additional auxiliary RF signals, the RF axial barrier will be applied equally to each end of the multipole. Further, the frequency of the RF axial barrier will be fixed at the frequency of the RF drive voltage, and the height of this barrier will be in direct proportion to the amplitude of the RF drive (see Eq. 1).

Figure 4:
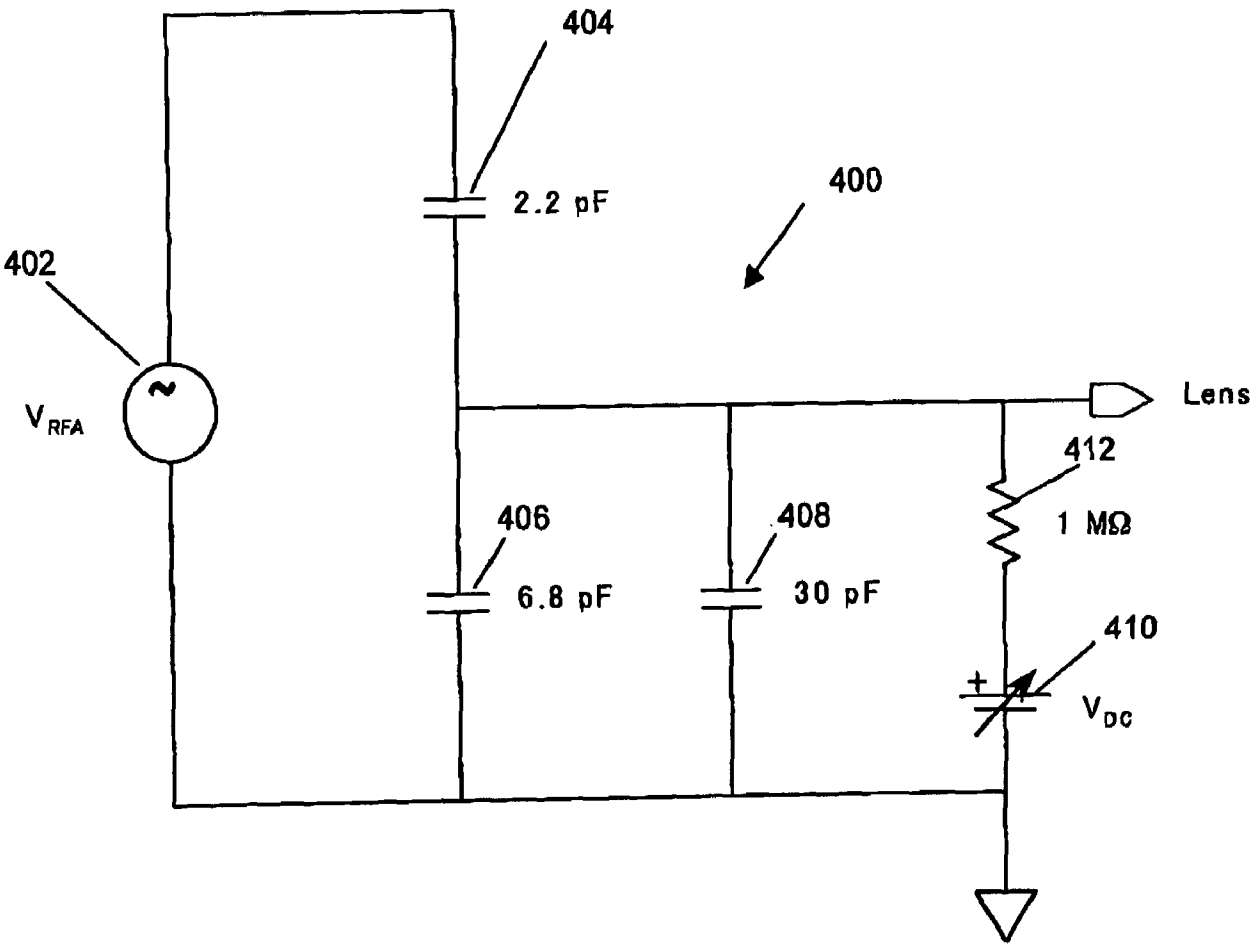
FIG. 4, in a schematic diagram, illustrates a capacitive divider for applying some portion of the drive RF voltage to a containment lens at an end of an ion guide to provide an auxiliary RF voltage at this end of the ion guide in accordance with a further aspect of the present invention.

Referring to FIG. 4, there is illustrated in a schematic diagram a circuit 400 for applying a portion of the RF drive voltage directly to a containment lens. Specifically, the circuit 400 of FIG. 4 illustrates how a capacitive divider can be used to apply some portion of the A-pole RF drive voltage to a containment lens. A drive voltage source 402 connected to the A-pole, is connected to a capacitive divider network consisting of a 2.2 pF capacitor 404 and a 6.8 pF capacitor 406. A 30 pF capacitor 408 represents the capacitance of the containment lens itself, and reduces the fraction of the A-pole RF appearing on the exit lens to about 6%. A DC voltage supply 410 provides a DC offset to the containment lens. A 1 MΩ resistor 412 isolates this DC voltage supply 410 from the RF voltage $V_{RF4}$.

The circuit 400 of FIG. 4 suffers from the same inflexibility of frequency and amplitude as the circuit 300 of FIG. 3, as the frequency and amplitude of the portion of the RF drive voltage applied to the containment lens will necessarily depend on the frequency and amplitude of the drive voltage itself. However, by adjusting the values of the capacitors 404 and 406, RF axial barriers of differing heights can be created at opposite ends of a multipole rod assembly.

Based on the foregoing, any of the elongated sets of rods in the mass spectrometer 100 can be used to trap ions of opposite polarity. Specifically, according to different aspects of the invention a first group of ions and a second group of ions can be provided to the elongated rod set from a first ion source and a second ion source respectively. The second group of ions can be opposite in polarity to the first group of ions. An RF drive voltage can be provided to the elongated rod set to radially confine both the first group of ions and the second group of ions within the rod set. Finally, an auxiliary RF voltage can be provided to both an entrance end and an exit end of the elongated rod set relative to the RF drive voltage to trap both the first group of ions and the second group of ions in the elongated rod set. This auxiliary RF voltage can be provided using any one of the circuits of FIGS. 2 to 4. Optionally, an exit auxiliary RF voltage and entrance auxiliary RF voltage, that are independently controllable, can be provided to the exit end and entrance end respectively.

For example, according to one aspect of the invention, the circuit of FIG. 3 can be used to provide an unbalanced RF drive voltage to the rod set. That is, the circuit 300 of FIG. 3 can be used to provide a first RF drive signal to the A-poles 304 and a second RF drive voltage to the B-poles 306. As described above, this configuration is equivalent to one in which the drive RF is balanced between the poles and an auxiliary signal at the RF frequency is applied to the containment lenses. Thus) in the manner described above, an auxiliary signal at the RF frequency can be applied at the entrance end and the exit end of the rod set relative to the RF drive voltage. Optionally, the auxiliary RF voltage applied to the entrance end and the exit end may be derived from the RF drive voltage. For example, this may be done using the capacitive divider of the circuit 400 of FIG. 4.

Optionally, the auxiliary RF voltage may be provided separately from the RF drive voltage. Further, as described above, different auxiliary RF voltages may be applied at the exit end and entrance end of the rod set. Optionally, a DC voltage may be superposed at the entrance end and the exit end of the rod set.

One of the advantages of providing the auxiliary RF voltage separately from the RF drive voltage is that the frequency and amplitude of the auxiliary RF voltage may be varied without varying the RF drive voltage. For example, the frequency of the exit auxiliary RF voltage applied to the exit end of the rod set can be reduced to axially eject lighter ions while retaining heavier ions Alternatively, the amplitude of the exit auxiliary RF voltage applied to the exit end of the rod set can be reduced to axially eject heavier ions while retaining lighter ions. Preferably, when adjusting the frequency of the auxiliary RF voltage, the resonance frequencies of the ions to be retained should be avoided.

Experimental Results

To provide the experimental results discussed below, the circuit 200 of FIG. 2, in which an auxiliary RF signal is applied directly to the containment lens, was used to supply an auxiliary RF signal directly to the exit lens of Q3 of FIG. 1. The auxiliary RF was produced by an Agilent signal generator and amplified by a factor of 10 by an auxiliary amplifier. In FIG. 2, this Agilent signal generator and auxiliary amplifier are jointly designated as the AC voltage source 202. As described above in connection with FIG. 2, the transformer 204 with a nominal gain of 10 is used to further boost the amplitude of the auxiliary RF signal.

A scan function was defined in which selective masses, or ranges of masses, were selected in Q1, transmitted through Q2, trapped in Q3, allowed to thermalize in Q3 and then subsequently detected. In the detection portion of these experiments, the height of the barrier, which was created when an auxiliary RF signal was applied to the exit lens, was reduced by various means and ions were detected when they exited the trap axially. Commonly, such experiments are referred to as charge decay experiments when trapped, thermalized ions leave the trap axially, principally in consequence of their own thermal motion, when a barrier, that had been containing them, is removed.

In many of the experiments described below, the Q3 rod-offset was scanned at 50 V/s in increments of 10 mV, with a 0.2 ms dwell time, from attractive to repulsive, relative to the exit lens 108. During the detection segment, the exit lens 108 was maintained at DC ground and no signal, other than the auxiliary RF, was applied to the exit lens 108. The amplitude of the RF drive was balanced, approximately, between the poles of Q3.

The effectiveness of the barrier to thermal ions, presented by the auxiliary RF signal on the exit lens, was evaluated by plotting the values of the Q3 rod offset (RO3) at which the centroids of the charge-decay distributions appeared as a functions of frequency, amplitude and mass. In fact, to facilitate the comparison of results obtained for both positive and negative ions the absolute values of RO3 were plotted against the parameters of interest.

In other experiments, to demonstrate more directly the mass-selective character of an RF axial barrier the potential difference between R03 and the exit lens was fixed at some specific value, nominally zero, and the amplitude of the auxiliary RF was ramped from a higher to lower value. Under these conditions, ions of higher mass were released axially at higher amplitude of the auxiliary RF than lighter ions.

Results And Discussion

It is noteworthy that the values of R03 at which the centroids of charge-decay distributions appeared were offset by 200 to 300 mV by the high (attractive) potential at the entrance to the detector 110, which penetrated the screen on the exit lens 108. The data that are presented below were corrected for this perturbation. That is, the results presented below were adjusted for zero-offset when the amplitude of the auxiliary RF signal was zero.

Frequency

Figure 5:
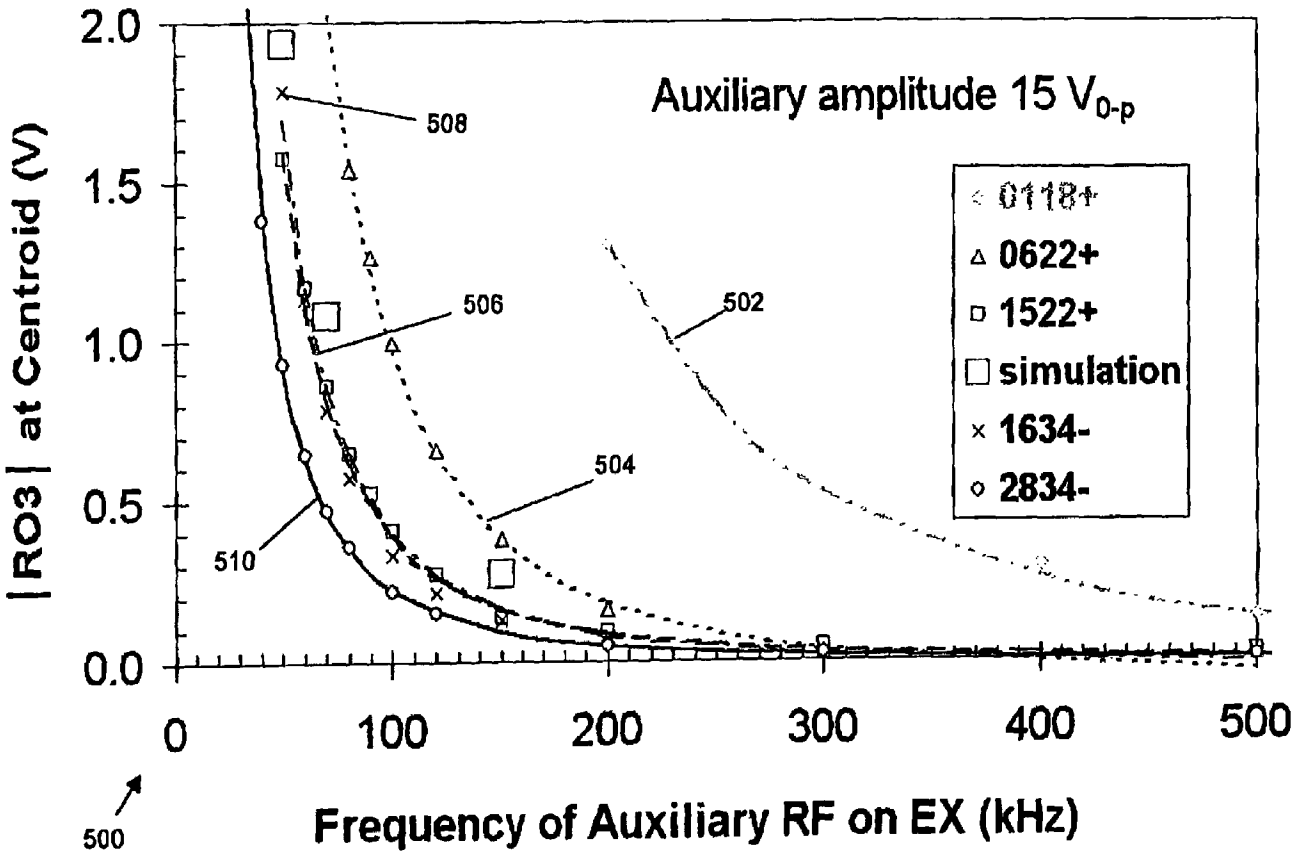
FIG. 5, in a graph, illustrates the Q3 rod offsets, at which the centroids of charge-decay distributions appeared, plotted as a function of the frequency of an auxiliary RF signal of amplitude 15 $V_{0\text{-}p}$, for five different ion masses.

Referring to the graph of FIG. 5, the Q3 rod offsets, at which the centroids of charge-decay distribution appeared, are plotted as a function of the frequency of an auxiliary RF signal of amplitude 15 V for five different masses. Specifically, curves 502, 504, 506, 508, and 510 represent the Q3 rod offset at which the centroids of charge-decay distributions occur as a function of the frequency of the auxiliary RF signal of amplitude 15 $V_{0-p}$ for $118^+$, $622^+$, $1522^+$, $1634^-$ and $2834^-$ ions respectively. In all cases, the effectiveness of the barrier increased with decreasing frequency, but only up to a point. When frequency was reduced below that of the threshold, the barrier became less effective rapidly as charge-decay distributions became skewed toward increasingly attractive values of the Q3 rod offset. It is clear from FIG. 5 that the minimum effective frequency increased with decreasing mass. This characteristic presents an opportunity for a degree of mass-selectivity in which higher mass ions are retained preferentially as frequency is reduced. The large squares appearing in the graph 500 show the results for mass $1522^+$ ions obtained from simulations of similar conditions.

Curves 502, 504, 506, 508, and 510 were obtained using the method of least squares, with a single adjustable parameter, to fit all of the data simultaneously to Eq. 1. In this fitting procedure, the value of RO3 at which the centroids of charge-decay distributions occurred, was substituted for the barrier height D. The goodness of the fit shows that the height of the axial barrier imposed by the auxiliary RF signal on the exit lens 108 is inversely proportional to the square of its frequency.

Amplitude

Figure 6:
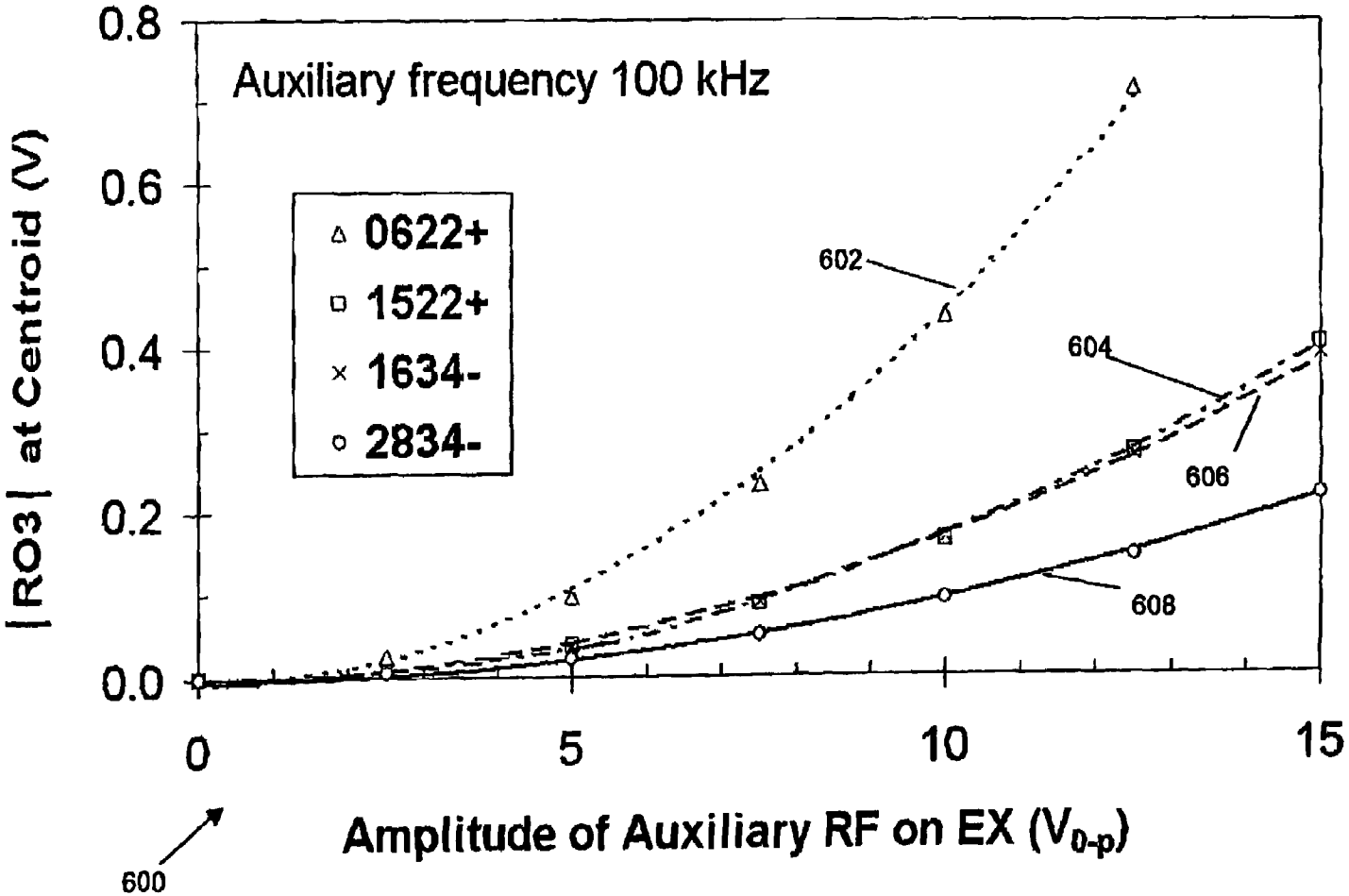
FIG. 6, in a graph, plot the magnitude of the Q3 rod offsets at which the centroids of charge-decay distributions occurred as a function of the auxiliary RF amplitude for ions of different masses.

Referring to FIG. 6, a graph 600 is provided for the case in which the frequency is held constant at 100 kHz and the amplitude of the auxiliary RF signal is varied between 0 and 15 V. This experiment was repeated for four different ions, $622^+$, $1522^+$, $1634^-$ and $2834^-$, which are plotted as curves 602, 604, 606 and 608 respectively of the graph 600 of FIG. 6. These curves plot the magnitude of RO3 at which the centroids of charge-decay distributions occurred as a function of the auxiliary RF amplitude.

As with the graph of FIG. 5, the curves 602, 604, 606 and 608 were obtained by using the method of least squares with a single adjustable parameter, to fit all of the data simultaneously to Eq. 1. Again it is clear that Eq. 1 describes well the height of the axial barrier imposed by an auxiliary RF signal on the exit lens. More specifically, the height of the barrier imposed by the auxiliary RF increases with the square of its amplitude. Based on FIG. 6, it also appears that the trapping effectiveness of an auxiliary signal of specific amplitude decreases with increasing mass. This is true for both positive and negative ions. In general, heavy ions are retained at higher frequencies, while lighter ions are retained at lower amplitudes.

Mass Selectivity

In these experiments, the height of the axial barrier was reduced by reducing the amplitude of the auxiliary RF at a constant rate with frequency and rod offset held constant, and observing charge-decay.

Consistent with Eq. 1, it is clear from FIGS. 5 and 6 that heavy ions are retained at higher frequency and lighter ions are retained at lower amplitude. Assuming, the energy distributions of the thermalized ions to be largely independent of mass, each mass could have been released axially when the height of the RF barrier had been reduced to the same nominal level. According to Eq. 1, the nominal level would correspond to different auxiliary RF amplitude for each mass. To investigate this mass dependence more directly, frequency of the auxiliary RF was fixed at 408 kHz, half that of the RF drive. Ions of mass 622, 922, 1522 and 2122 were selected in Q1 and accumulated, and thermalized, in Q3.

Figure 7:
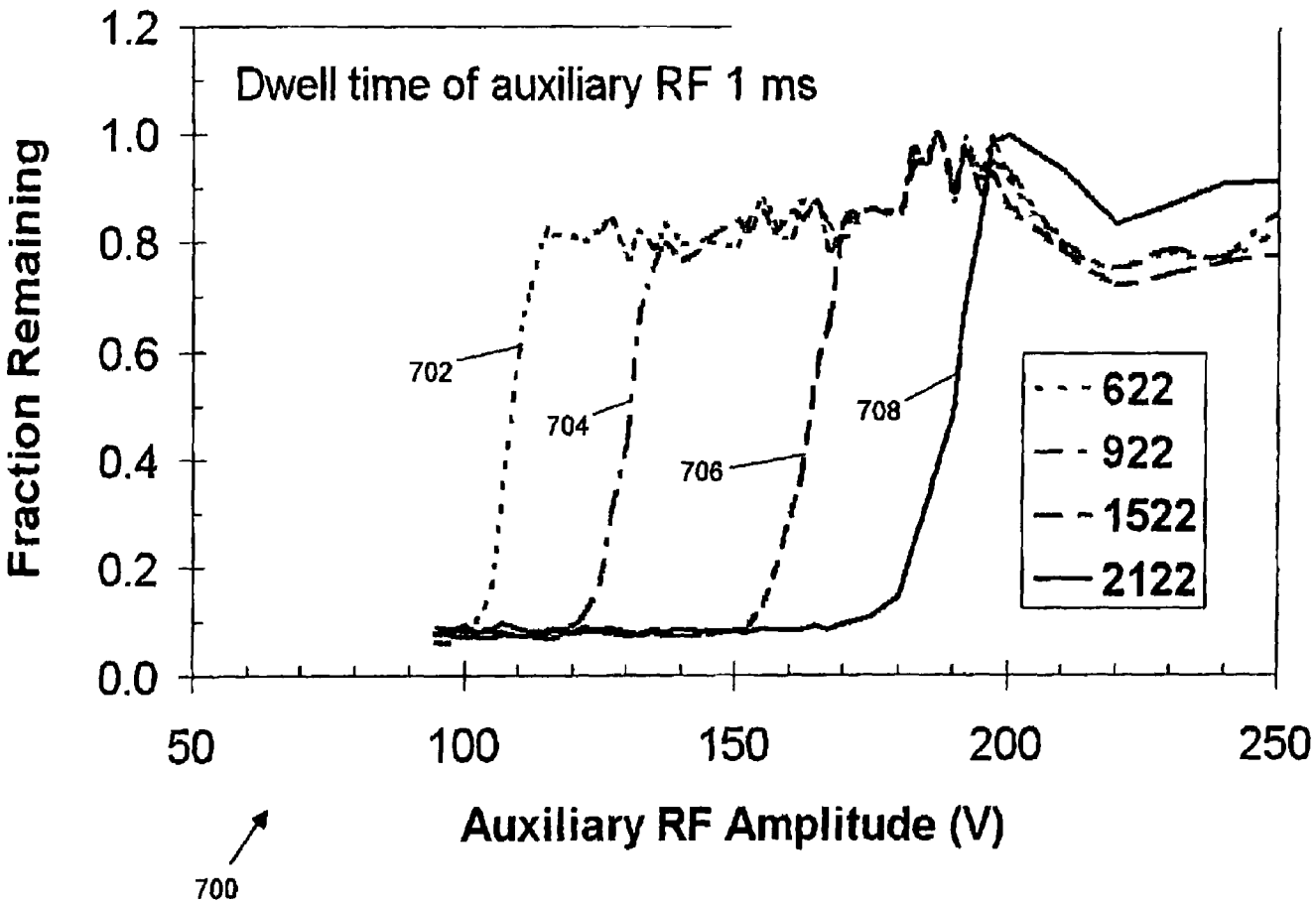
FIG. 7, in a graph, plots the integrated intensity of each isotope cluster for ions of different masses as a function of the amplitude to which the auxiliary RF was reduced for 1 ms.

To generate the data of a graph 700 of FIG. 7, after ions had been accumulated and thermalized in Q3, the amplitude of the auxiliary RF was reduced to some specific value for 1 ms period, the auxiliary RF on the axial lens was replaced by a DC barrier and the remaining ions were detected by mass selective axial ejection. Curves 702, 704, 706 and 708 of the graph 700 of FIG. 7, plots the integrated intensity of ions of mass 622, 922, 1522 and 2122 respectively, as a function of the amplitude to which the auxiliary RF was reduced for 1 ms. This procedure was repeated many times to generate the data of FIG. 7. It is clear from FIG. 7 that ions below a certain mass can be retained in the trap preferentially, while heavier ions are lost axially, by reducing the amplitude of the auxiliary RF to a suitable level.

Figure 8:
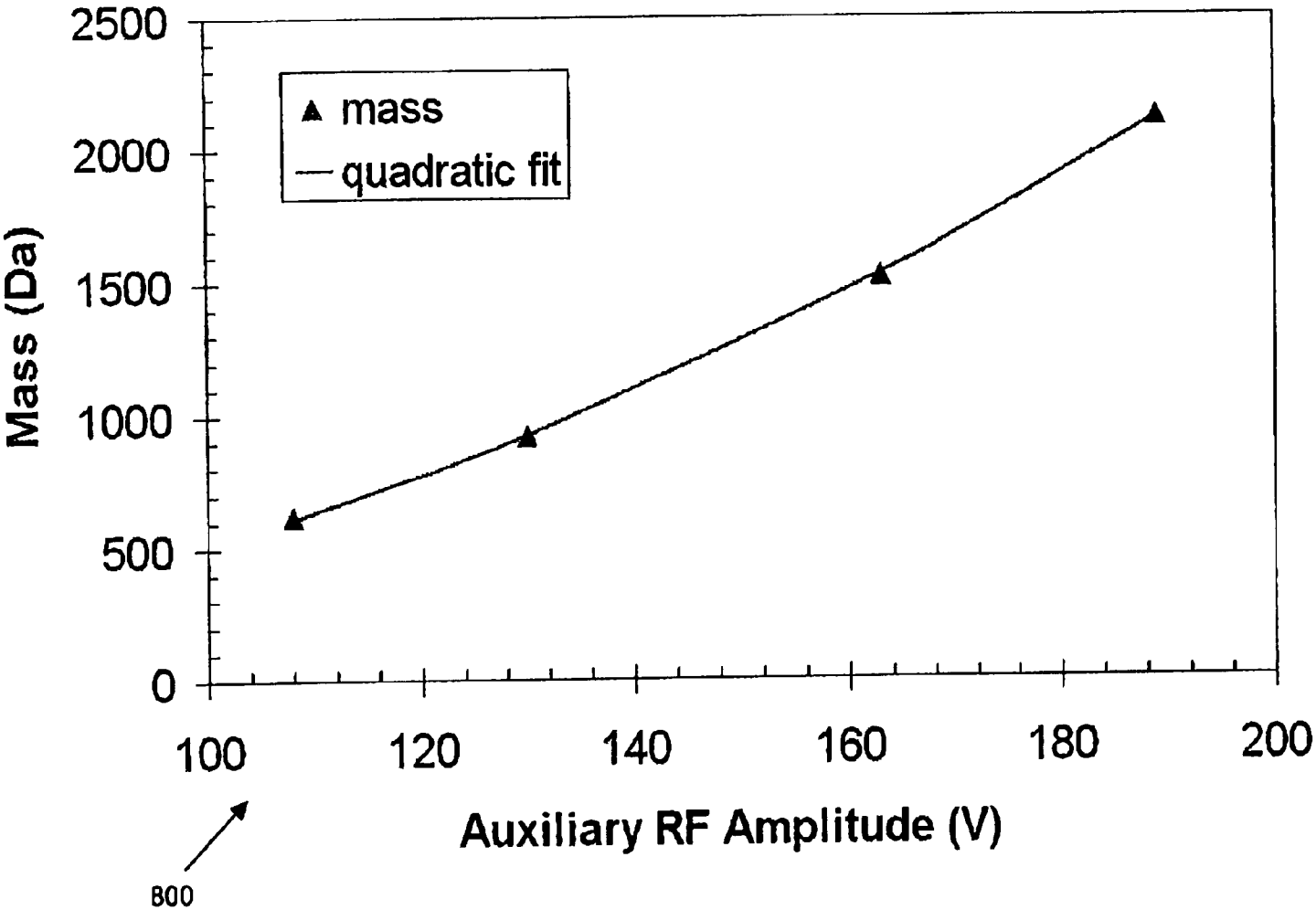
FIG. 8, in a graph, plots ion mass as a function of the value of the amplitude of the auxiliary RF at which the intensity of each ion mass has dropped to half of its maximum value in the graph of FIG. 7.

Referring to the graph 800 of FIG. 8, the mass of each of the ions of FIG. 7 is plotted as a function of the value of the amplitude for the auxiliary RF, at which the intensity of each ion had dropped to half of its maximum value in FIG. 7. The quadratic curve, which was fit to the four data points, demonstrates the quadratic dependence of mass upon the auxiliary RF amplitude, as predicted by Eq. 1.

The results of FIG. 8 imply that ions can be ejected axially with some degree of mass selectivity by ramping the amplitude of the auxiliary RF on the exit lens from a level sufficiently high to retain all ions to zero.

Figure 9A:
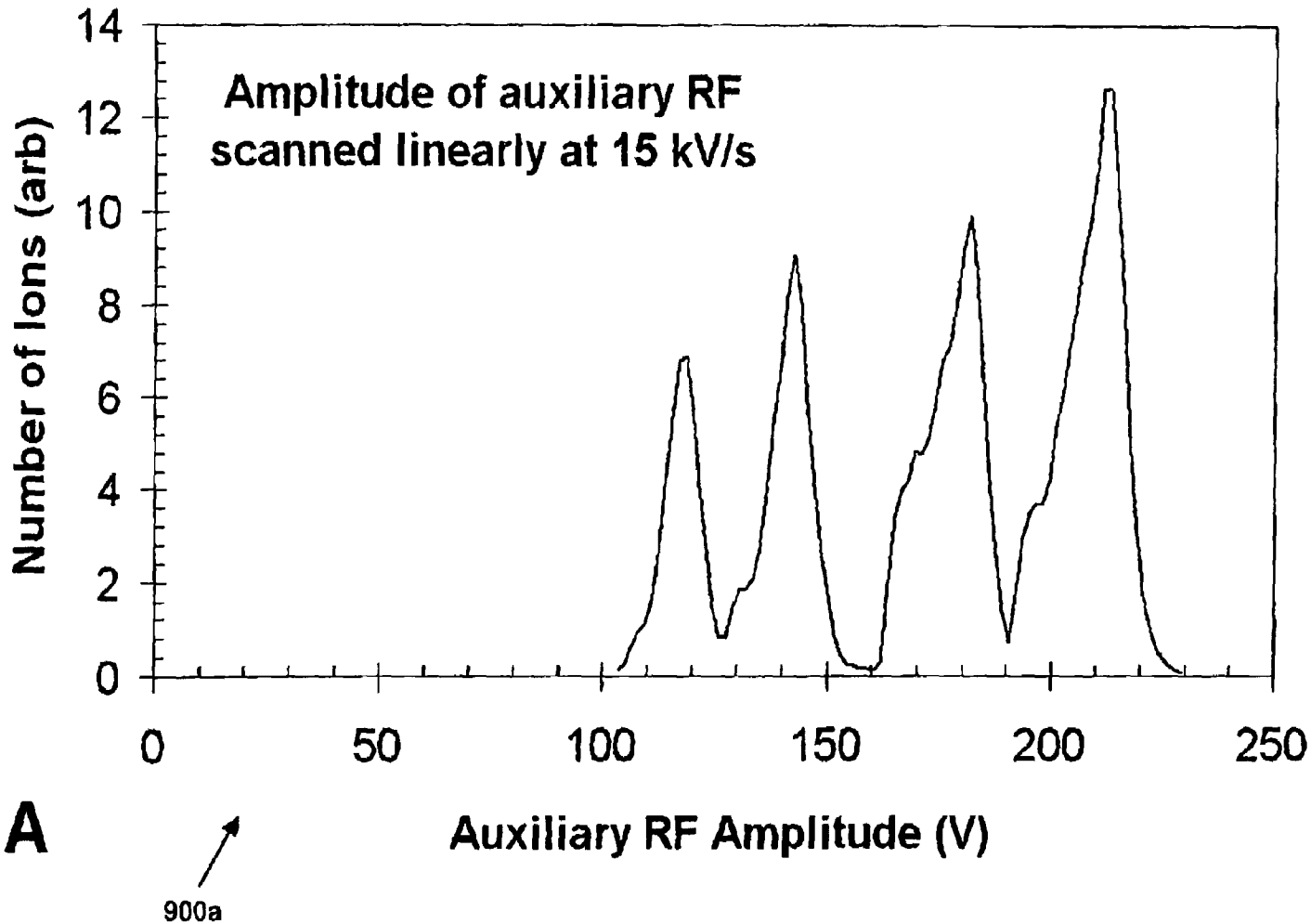
FIG. 9*a* plots the intensity of an ion current exiting a linear ion trap as a function of auxiliary RF amplitude.
Figure 9B:
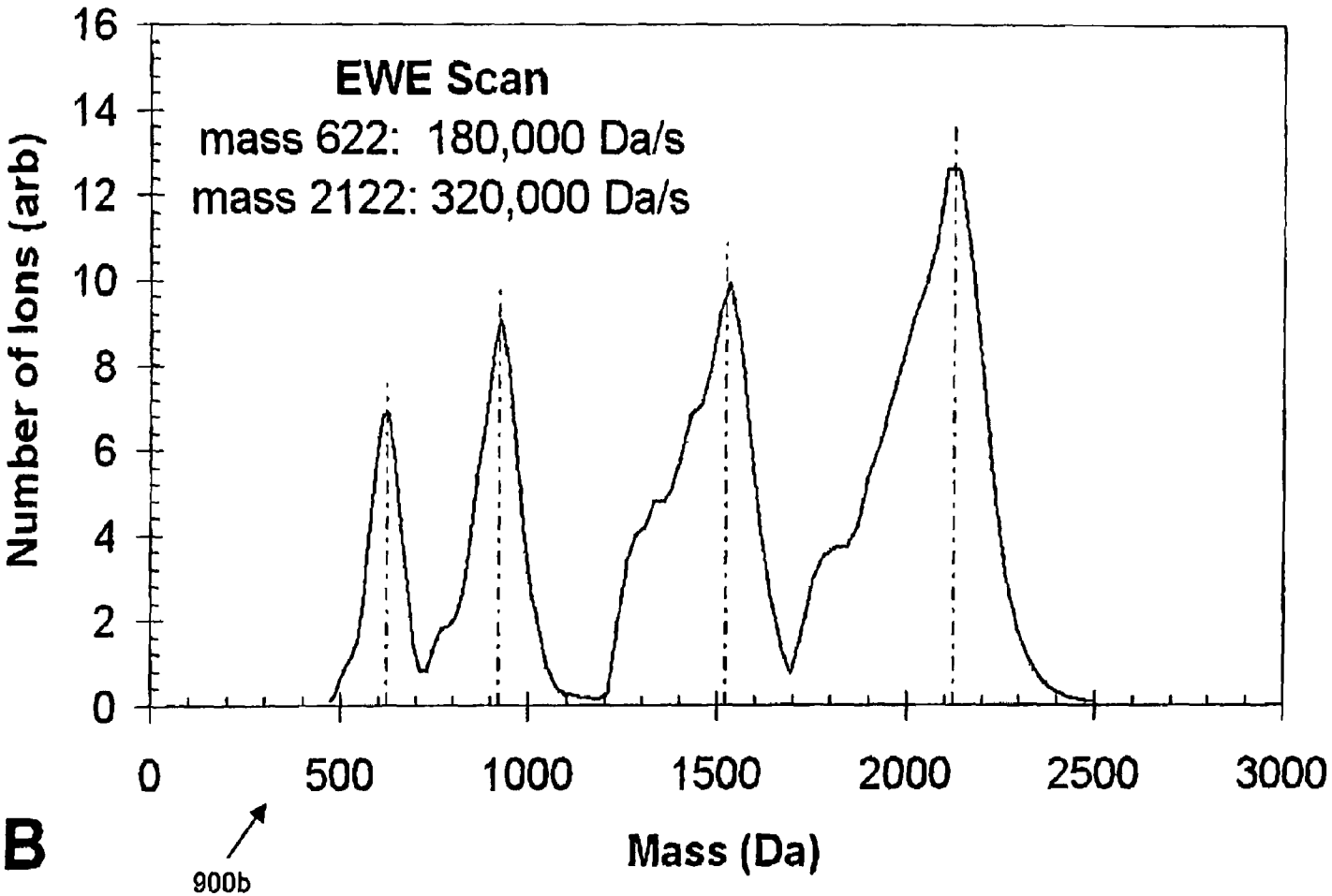
FIG. 9*b*, in a graph illustrates the same relationship as FIG. 9*a*, except that, using the quadratic relationship between amplitude and mass, the data of FIG. 9*a* has been transformed to the mass domain.

Referring to the graphs of FIGS. 9*a* and 9*b*, the results of ramping the amplitude of a 408 kHz, auxiliary RF signal on the exit lens 108 from 250 V to zero at −15 kV/s per second is plotted. The intensity of the ion current exiting a linear ion trap has been plotted as the function of the auxiliary RF amplitude in FIG. 9*a*. Using the quadratic relationship between amplitude and mass, the data of FIG. 9*a* was transformed to the mass domain and displayed in FIG. 9*b*. The vertical dashed lines in FIG. 9*b* indicate the positions of masses 622, 922, 1522 and 2122. These masses were selected in Q1 and accumulated and thermalized in Q3.

Although the mass spectrum of FIG. 9*b* is resolved poorly, the maxima are positioned appropriately on the mass axis. It is noteworthy that when amplitude was ramped linearly with time, mass changed quadratically. Specifically, the ramp rate, expressed in units of mass per second, varied from 180 kDa/s for mass 622 to 320 kDa/s for mass 2122.

Quadrupolar Resonant Excitation

When the frequency of an auxiliary RF signal applied to a containment lens corresponds to a parametric, or quadrupolar, resonance, ions can suffer radial resonant excitation and be neutralized on the rods or ejected axially. Consequently, ions of particular mass are not trapped effectively by an axial RF barrier when the frequency of the auxiliary RF signal corresponds to a quadrupolar resonance for those ions. This effect is illustrated by the data plotted in FIGS. 10*a* and 10*b*.

Figure 10A:
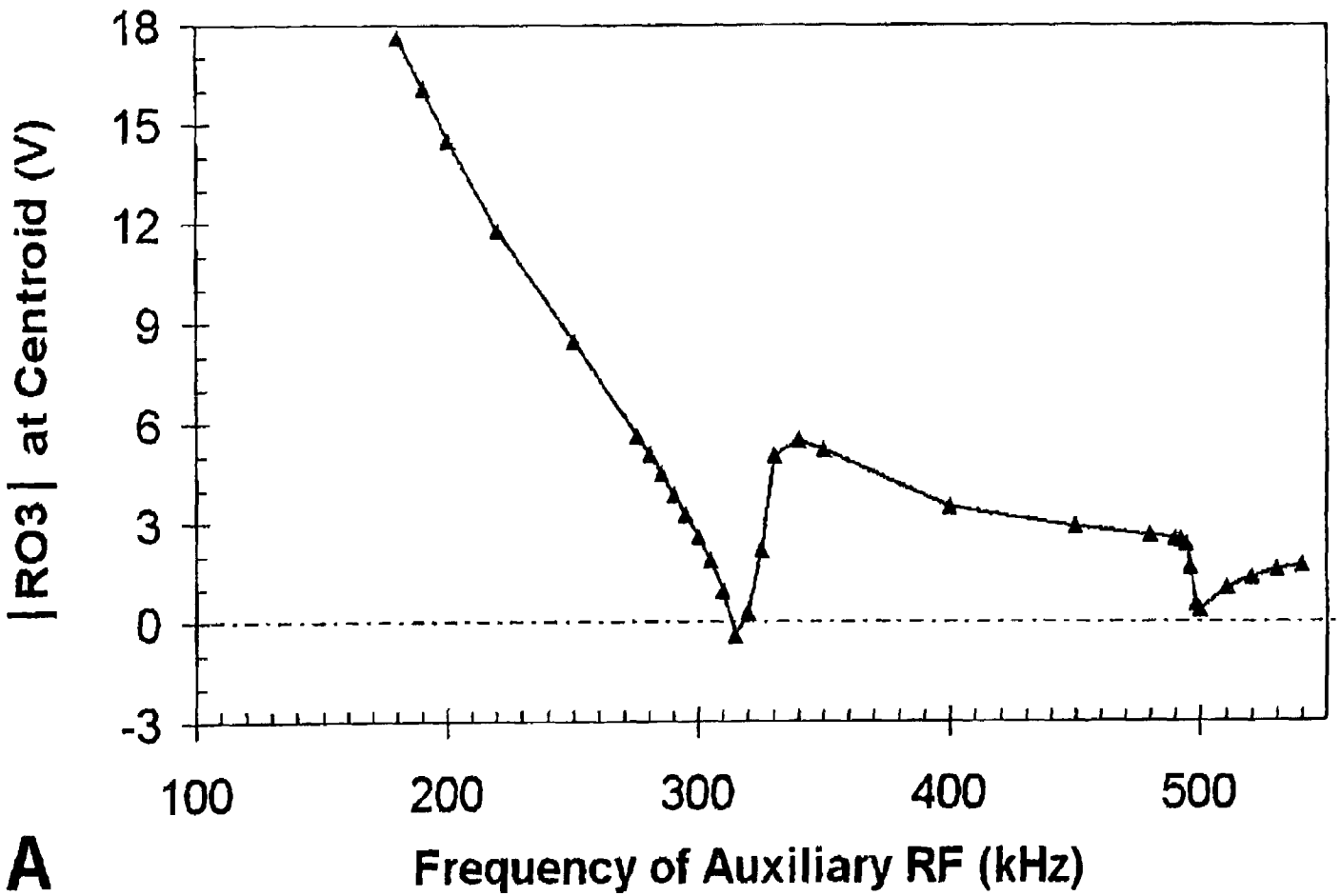
FIG. 10*a*, in a graph, plots the magnitude of the Q3 rod offset at which the centroids of the charge-decay distributions of 1634– occur as a function of frequency.

In FIG. 10*a*, the amplitude of the auxiliary RF signal was fixed at 150 V up. Frequency was varied between 200 and 600 kHz to collect frequency response data, similar to that of FIG. 5, for negative ion 1634−. That is, in FIG. 10*a* the magnitude of the Q3 rod offset at which the centroids of the charge-decay distribution of 1634− occurred, adjusted for 0 offset at 0 amplitude, were plotted as a function of frequency.

Figure 10B:
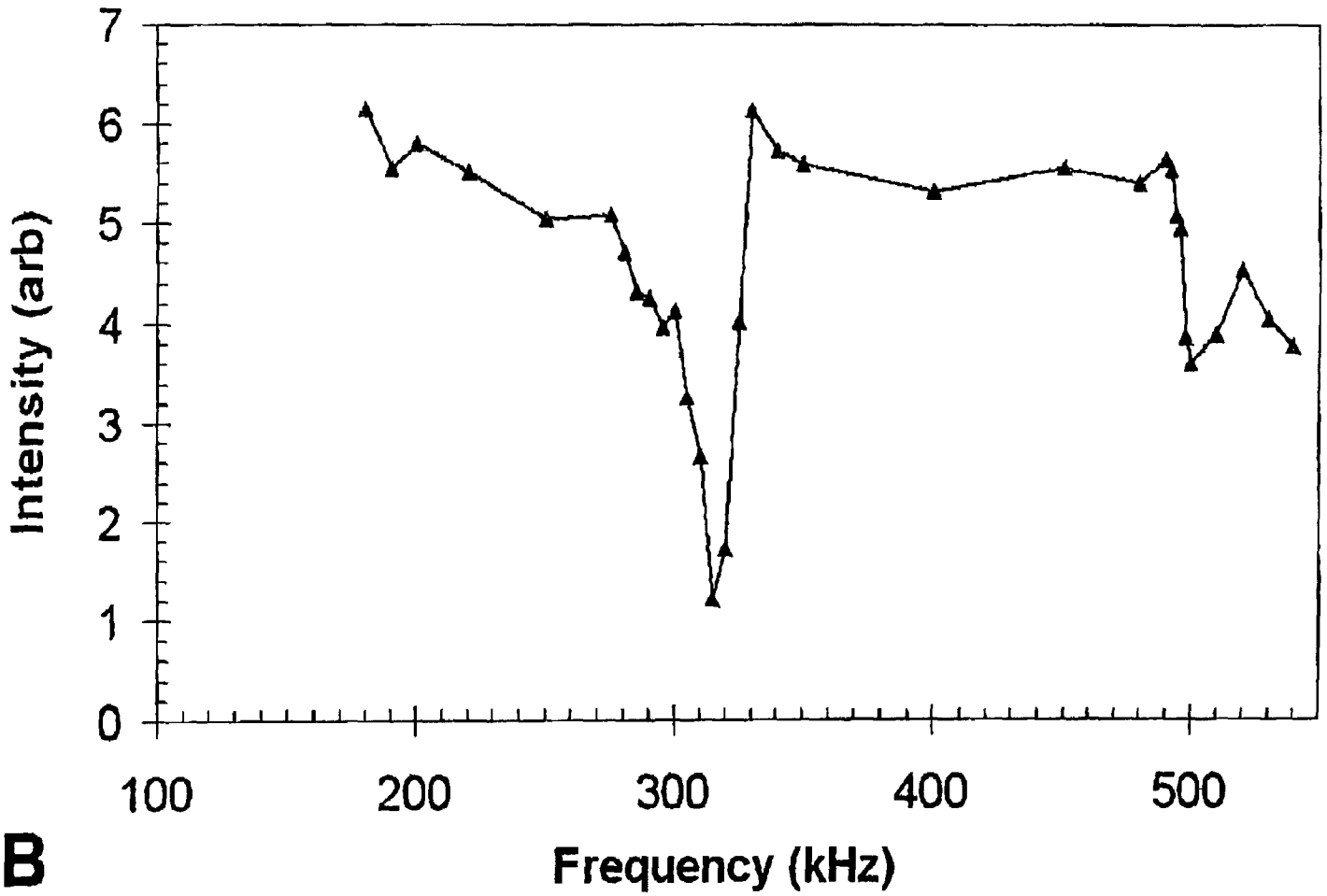
FIG. 10*b*, in a graph, plots the integrated intensities of the charge-decay distributions of FIG. 10*a* as a function of frequency; and, FIG. 11, in a graph plots the integrated intensities of the charge-decay distributions of a function of the Q3 rod offset, which was maintained for 2000 ms, while a 200 kHz auxiliary signal was applied to the exit lens with an amplitude of 150 V.

In FIG. 10*b*, the integrated intensities of these charge-decay distributions were plotted as a function of frequency. Quadropole resonances were observed at 315 kHz and 500 kHz, corresponding to (K, n)=(1,0) and (1,−1) quadropolar resonances. (B. A Collings, M. Sudakov and F. A. Londry, "Resonance Shifts in the Excitation of the n=0, K=1 to 6 Quadrupole resonances for Ions Confined in a Linear Ion Trap," J Am Soc Mass Spectrom 2002, 13, 577–586).

These resonances would have resulted in radial parametric excitation with concomitant losses on the rods or mass-selective axial ejection. This explains the sharp minima in the intensity data of FIG. 10*b*. The corresponding minima in FIG. 10*a* are a consequence of ions gaining radial amplitude significantly above thermal levels. The axial force, which ions feel in response to a potential on the exit lens, decreases with radial amplitude and the minima of FIG. 10*a* simply reflect a reduced axial barrier to radially excite ions. In fact, FIG. 10*a* shows that the height of the barrier dropped below zero at 316 kHz. Combined with a sharp minimum at 315 kHz in FIG. 10*b*, it is clear that ions were experiencing mass selective axial ejection at 315 kHz. Thus, it seams clear that the axial barrier imposed when an auxiliary RF signal is applied to a containment lens becomes ineffective for a particular m/z when its frequency corresponds to a quadrupole resonance. Accordingly, such frequencies should be avoided when trapping ions.

Effectiveness of an RF Barrier Over Time

The charge-decay distributions examined above imply that ions could be trapped effectively for a relatively long period of time. Even so, when trapping ions on a time scale of seconds a slow leak can result in significant losses. To test the trapping effectiveness over time, a 200 kHz auxiliary signal was applied to the exit lens with amplitude 150 V while the Q3 rod offset was maintained at a specific value. After 2000 ms, RO3 was ramped to increasingly repulsive values at 50 V/s.

Figure 11:
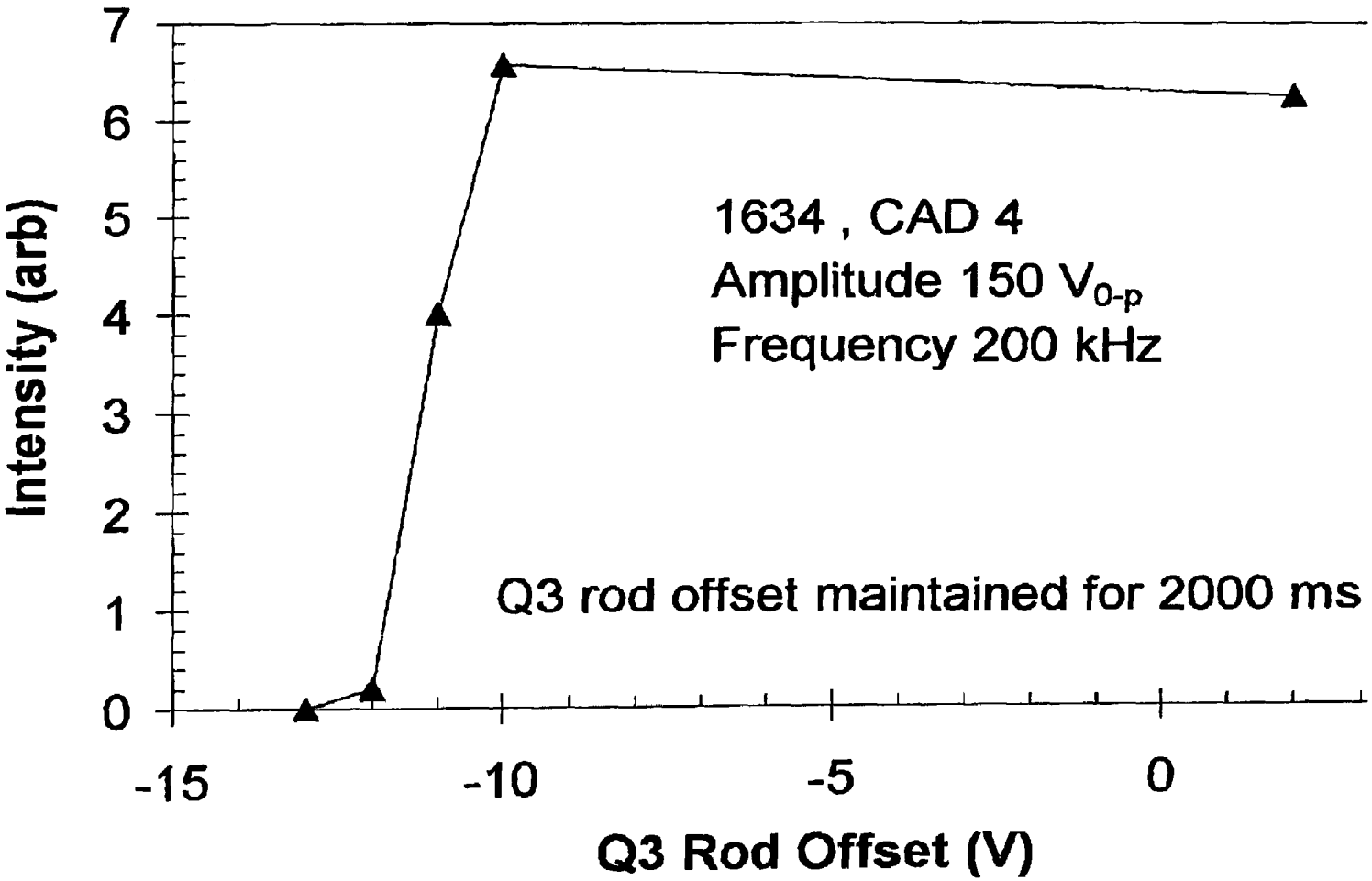

Referring to the graph of FIG. 11, the integrated intensities of the charge-decay distributions are plotted as a function of the Q3 rod offset, which was maintained for 2000 ms. The data of FIG. 11 implies that the auxiliary RF signal applied to the exit lens contained the 1634− ions as effectively as would a 10 V DC blocking potential.

From the forgoing, it is clear that an auxiliary RF signal in the frequency range 300 kHz to 1 MHz, which is phase independent of the RF drive, can trap thermal ions when it is applied to a containment lens at the end of a quadrupole linear ion trap. Of course, this frequency range is arbitrary and need not be independent of the RF drive. That is, for very heavy, singly charged ions, frequencies much lower than 30 kHz would be effective Furthermore, it may be advantageous to use frequencies greater than 1 MHz to avoid the strongest quadrupolar resonances.

Ions of both polarities can be trapped simultaneously and efficiently by auxiliary RF signals applied to containment lenses at both ends of a quadrupole linear ion trap. The effective height of such an RF barrier would (i) be inversely proportional to the mass of an ion, (ii) increase linearly with the magnitude of the charge carried by the ion, (iii) be independent of charge polarity of the ion, (iv) increase quadratically with the amplitude of the auxiliary RF signal, (v) be inversely proportional to the square of the frequency of the auxiliary RF signal, and (vi) increase with decreasing frequency, but only up to a point. In the case of this last feature, when frequency is reduced below a certain mass-dependent threshold, the effectiveness of the barrier diminishes abruptly.

As a result of the greater axial speeds of lower-mass ions, the low-frequency threshold for effective containment increases as ion mass decreases. This characteristic offers a degree of mass-selectivity whereby higher mass ions could be trapped preferentially: by reducing the RF barrier frequency to eject lighter ions. At frequencies above the threshold for effective trapping, the effective height of an RF barrier is inversely proportional to mass. This characteristic provides a means of trapping lighter ions preferentially.

As the amplitude of the auxiliary RF is scanned from a higher to a lower value, ions of greater mass can be released axially before lighter ions.

An auxiliary RF signal applied to the exit lens can excite quadrupolar (K, n) resonances, particularly when the amplitude of the auxiliary signal is high. Ions that come into resonance with one of the (K, n) frequencies can be either lost axially, or neutralized on the rods.

It should be further understood that various modifications can be made by those skilled in the art, to the preferred embodiments described and illustrated herein without departing from the present invention, the scope of which is defined in the appended claims.

What is claimed is:

1. A method of operating a mass spectrometer having an elongated rod set, the rod set having an entrance end, an exit end, a plurality of A rods and a plurality of B rods; the method comprising:

(a) providing a first group of ions within the rod set;

(b) providing a second group of ions within the rod set, the second group of ions being opposite in polarity to the first group of ions;

(c) providing a first RF signal to the plurality of A rods and a second RF signal to the plurality of B rods to provide a RF drive voltage to the rod set to radially confine the first group of ions and the second group of ions in the rod set; and, (d) providing an entrance auxiliary RF voltage to the entrance end and an exit auxiliary RF voltage to the exit end relative to the RF drive voltage, to trap both the first group of ions and the second group of ions in the rod set, wherein the entrance auxiliary RF voltage applied to the entrance end and the exit auxiliary RF voltage applied to the exit end are derived from the RF drive voltage, and step (d) comprises providing a capacitive dividing network between the first RF signal and a ground to derive an auxiliary RF voltage from the first RF signal, the auxiliary RF voltage being one of the entrance auxiliary RF voltage applied to the entrance end and the exit auxiliary RF voltage applied to the exit end.

2. A method of operating a mass spectrometer having an elongated rod set, the rod set having an entrance end and an exit end, the method comprising:

(a) providing a first group of ions within the rod set;

(b) providing a second group of ions within the rod set, the second group of ions being opposite in polarity to the first group of ions;

(c) providing a RF drive voltage to the rod set to radially confine the first group of ions and the second group of ions in the rod set; and, (d) providing an entrance auxiliary RF voltage to the entrance end and an exit auxiliary RF voltage to the exit end relative to the RF drive voltage, to trap both the first group of ions and the second group of ions in the rod set, and wherein the exit auxiliary RF voltage is provided separately from the RF drive voltage; and has a frequency controlled independently of the RF drive voltage; and wherein the step of controlling the frequency of the exit auxiliary RF voltage comprises avoiding resonance frequencies of the first group of ions and the second group of ions.

* * * * *